US007421839B2

(12) United States Patent
Igarashi

(10) Patent No.: US 7,421,839 B2
(45) Date of Patent: Sep. 9, 2008

(54) EXHAUST EMISSION CONTROL DEVICE

(75) Inventor: Tatsuki Igarashi, Hino (JP)

(73) Assignee: Hino Motors, Ltd., Hino-shi (JP)

( * ) Notice: Subject to any disclaimer, the term of this patent is extended or adjusted under 35 U.S.C. 154(b) by 0 days.

(21) Appl. No.: 10/572,309

(22) PCT Filed: Sep. 10, 2004

(86) PCT No.: PCT/JP2004/013226

§ 371 (c)(1),
(2), (4) Date: Dec. 26, 2006

(87) PCT Pub. No.: WO2005/028824

PCT Pub. Date: Mar. 31, 2005

(65) Prior Publication Data

US 2007/0137186 A1 Jun. 21, 2007

(30) Foreign Application Priority Data

Sep. 19, 2003 (JP) ..... 2003-328341

(51) Int. Cl.
*F01N 3/00* (2006.01)

(52) U.S. Cl. ..... 60/297; 60/274; 60/288; 60/295; 60/300; 60/311

(58) Field of Classification Search ..... 60/287, 60/288, 297, 300, 311, 295
See application file for complete search history.

(56) References Cited

U.S. PATENT DOCUMENTS 4,538,411 A * 9/1985 Wade et al. ..... 60/274
4,558,565 A * 12/1985 Kojima et al. ..... 60/286
4,831,821 A * 5/1989 Takeshima ..... 60/286
5,388,406 A * 2/1995 Takeshima et al. ..... 60/297

(Continued)

FOREIGN PATENT DOCUMENTS

DE 198 49 262 4/2000

(Continued)

OTHER PUBLICATIONS

Written Opinion of the International Search Authority, PCT International Patent Application No. PCT/EP2004/009110 (translation of Supplementary Pages provided).

(Continued)

*Primary Examiner*—Thomas Denion
*Assistant Examiner*—Diem Tran
(74) *Attorney, Agent, or Firm*—Oblon, Spivak, McClelland, Maier & Neustadt, P.C.

(57) ABSTRACT

Attained is a heat generative exhaust emission control device with less electric power consumption and with no harmful gas discharged to atmosphere.

A porous filter body 7 for capturing particulates in exhaust gas 2 through passing of the exhaust gas 2 is provided with an electric heater 9 so as to heat the filter body 7; thus, a heat regenerative particulate filter 10 is provided. The heat regenerative particulate filters 10 are accommodated in filter casings 11 and 12 within an exhaust pipe 3, and oxidation catalysts 13 and 14 are arranged upstream and downstream of and adjacent to the heat regenerative particulate filter 10 so as to obtain thermo-keeping or heat insulation effect to the heat regenerative particulate filter 10.

1 Claim, 3 Drawing Sheets

U.S. PATENT DOCUMENTS

2003/0190269 A1* 10/2003 Liu et al. ..... 422/168

FOREIGN PATENT DOCUMENTS

| | | |
|---|---|---|
| JP | 62-255512 | 11/1987 |
| JP | 4-47113 | 2/1992 |
| JP | 6-146858 | 5/1994 |
| JP | 10-252447 | 9/1998 |
| JP | 10-266826 | 10/1998 |

OTHER PUBLICATIONS

U.S. Appl. No. 10/572,309, filed Dec. 26, 2006, Igarashi.
U.S. Appl. No. 11/661,428, filed Feb. 28, 2007, Igarashi.

* cited by examiner

EXHAUST EMISSION CONTROL DEVICE

TECHNICAL FIELD

The present invention relates to an exhaust emission control device for removing particulates in exhaust gas from an internal combustion engine such as a diesel engine.

BACKGROUND ART

Particulates or particulate matter discharged from a diesel engine is mainly constituted by carbonic soot and a soluble organic fraction (SOF) of high-boiling hydrocarbon and contains a trace of sulfate (misty sulfuric acid fraction). In order to suppress such kind of particulates from being discharged into atmosphere, it has been envisaged as shown in FIG. 1 that a particulate filter 4 is incorporated in an exhaust pipe 3 through which exhaust gas 2 from a diesel engine 1 flows.

As detailedly shown in FIG. 2, the particulate filter 4 comprises a filter body 7 in the form of a porous honeycomb made of ceramics such as cordierite. The filter body 7 has passages 5 in the form of grid-like compartments with inlets alternately plugged by plugs 8, the passages 5 with the unplugged inlets being plugged at their outlets by the plugs 8. Only the exhaust gas 2 passing through porous thin walls 6, which compartmentalize the passages 5, is discharged downstream and the particulates are captured at inner surfaces of the walls 6.

The particulates in the exhaust gas 2 are thus captured by and accumulated on the inner surfaces of the walls 6 and spontaneously ignite to be burned off upon operational shifting to a region of operation with increased exhaust temperature. However, when an operation or driving with temperature at or above a predetermined temperature requisite tends not to continue for a long time, for example, in a vehicle such as a shuttle bus running mainly on congested city roads, there may be a fear that an accumulated particulate amount exceeds a treated particulate amount, disadvantageously resulting in clogging of the particulate filter 4.

Thus, provision of an electric heater has been investigated so as to satisfactorily burn off particulates even in a region of operation with lower exhaust temperature. Positive heating by this kind of electric heater will make it possible to satisfactorily burn off particles even in the region of operation with lower exhaust temperature.

As to heat regenerative particulate filters with electric heater, for example, the following Reference 1 has been proposed by the applicant of the present invention.

Reference 1: JP 62-255512A

SUMMARY OF THE INVENTION

Problems to be Solved by the Invention

However, in the conventional proposal of utilizing such electric heater, much electric power consumption is required for regeneration of the particulate filter 4 so that required is a power source which is bulky to an extent unaffordable by any existing vehicle buttery. Moreover, charging is required which corresponds to the consumed electric power, disadvantageously resulting in deterioration of fuel mileage.

There may be also a fear that harmful gas such as high concentrated CO and/or HC may be generated and discharged into atmosphere since the particulates are burned off at relatively low temperature upon regeneration of the particulate filter 4.

The invention was made in view of the above and has its object to provide a heat regenerative exhaust emission control device with less electric power consumption and with no harmful gas discharged into atmosphere.

MEANS OR MEASURE FOR SOLVING THE PROBLEMS

The invention is directed to an exhaust emission control device comprising a porous filter body through which exhaust gas passes for capturing of particulates entrained in the gas and having an electric heater for heating the filter body to thereby provide a heat regenerative particulate filter, said heat regenerative particulate filter being accommodated in a filter casing within an exhaust pipe, oxidation catalysts being arranged upstream and downstream of and adjacent to the particulate filter in the filter casing so as to obtain thermokeeping or heat insulation effect to the particulate filter.

Thus, when the exhaust gas having flown into the filter casing passes through the upstream oxidation catalyst, NO occupying majority of $NO_x$ in the exhaust gas is converted into highly reactive $NO_2$, which substantially accelerates an oxidization reaction of the particulates to bring about satisfactory burn-off of the particulates in a condition of operation with exhaust temperature above about 250° C.

However, when a condition of light-load operation with exhaust temperature greatly falling below 250° C. continues for a long time, for example, during running or driving on congested city roads, satisfactory burn-off of the particulates cannot be expected. Then, at a right moment when an accumulated particulate amount is estimated to exceed a predetermined amount (estimation may be based on, for example, operational time period or pressure difference between the entering and discharge sides of the filter body), the electric heater is energized to positively heat the filter body.

Such positive heating of the filter body by the electric heater accelerates the oxidization reaction of the particulates captured by the filter body. As a result, the particulates are satisfactorily burned off even in the condition of operation with lower exhaust temperature.

In this case, the heat regenerative particulate filter is sandwiched and heat insulated by the upstream and downstream oxidation catalysts in one and the same filter casing, so that the filter body is rapidly elevated in temperature by heating the same through the electric heater. Because of a resultant tendency of the particulates being more easily burned off, the burn-off can be completed with a shorter energization time than they could conventionally and thus required electric power consumption is less than that required conventionally.

The harmful gas such as highly concentrated CO and/or HC generated due to burn-off of the particulates with relatively low temperature through heating by the electric heater is oxidized into harmless $CO_2$ and/or $H_2O$ when it passes through the downstream oxidation catalyst, and is discharged.

It is preferable in the invention to be structured such that the exhaust gas may bypass the filter casing. This makes it possible to heat the filter body by the electric heater without exposing it to the flow of the exhaust gas through bypassing of the exhaust gas, so that heat from the electric heater can be efficiently imparted to the filter body without being robbed of by the exhaust gas.

A plurality of filter casings may be arranged in parallel with each other with the exhaust gas bypassing any one or ones of the filter casings. Then, while the exhaust gas bypasses such filter casing or casings and flows through the remaining filter casings, the electric heater or heaters in the bypassed filter casing or casings can be heated to regenerate the filter body or bodies therein, capturing of the particulates being continued by the filter bodies in the remaining filter casings.

In such case where the exhaust gas bypasses the filter casing or casings to which heating by the electric heater or heaters is made, it is preferable that combustion air is fed to the bypassed filter casing or casings. This improves the oxidizing atmosphere in the filter body or bodies into enhanced combustibility of the captured particulate.

It is preferable in the invention that filter body integrally carries oxidation catalyst, which accelerates the oxidization reaction of the particulates captured by the filter body to lower the ignition temperature thereof. As a result, combustibility of the particulates in the condition of temperature with lower exhaust temperature is further enhanced to thereby attain further improved burn-off of the particulate.

When the invention is to be carried out more concretely, employable is a filter body which has a great number of passages in the form of honeycomb through which the exhaust gas passes, inlets and outlets of the respective passages being alternately plugged. In such employment of the filter body, it is preferable that at least a front end surface of the filter body is fitted with an electric heater.

EFFECTS OF THE INVENTION

According to the above-mentioned exhaust emission control device of the invention, the following various meritorious effects can be obtained:

(I) The particulates captured by the filter body can be effectively burned off through heating by the electric heater even in a condition of operation such as light-load operation with lower exhaust temperature. Moreover, the filter body can be rapidly elevated in temperature into environment for easy burn-off due to thermo-keeping or heat insulation effect by the upstream and downstream oxidation catalysts. As a result, the particulates can be burned off with a shorter energization time than they could conventionally, thereby attaining substantial reduction in electric power consumption.

(II) The harmful gas such as highly concentrated CO and/or HC generated due to burn-off of the particulates with relatively low temperature through heating by the electric heater can be oxidized into harmless $CO_2$ and/or $H_2O$ during passage through the downstream oxidation catalyst, and is discharged. As a result, the harmful gas is prevented from remaining in the exhaust gas finally discharged into atmosphere.

(III) NO occupying majority of $NO_x$ in the exhaust gas can be converted into highly reactive $NO_2$ while the exhaust gas passes through the upstream oxidation catalyst, which can substantially accelerate the oxidization reaction of the particulates in a condition of operation with relatively high exhaust temperature. This promotes spontaneous combustion of the particulates in a case where no heating is added by an electric heater, thereby attaining satisfactory burn-off.

(IV) In a case where the exhaust gas may bypass the filter casing, the filter body can be effectively heated by the electric heater without being exposed to the flow of the exhaust gas. As a result, the particulates can be burned off with a further short energization time to thereby attain further substantial reduction in electric power consumption.

(V) In a case where a plurality of filter casings are arranged in parallel with each other and the exhaust gas may arbitrarily bypass any filter casing or casings, while the filter body or bodies in the bypassed filter casing or casings are regenerated, capturing of the particulates is continued by the filter bodies in the remaining filter casings. As a result, the filter bodies in some of the filter casings are always usable to thereby continuously attain reduction in amount of the particulates.

(VI) In a case where combustion air may be fed to the bypassed filter casing, the oxidizing atmosphere in the filter body is improved into improved combustibility of the captured particulate. As a result, the particulates can be completely burned off with a further short energization time to thereby attain still further substantial reduction in electric power consumption.

(VII) When the filter body integrally carries the oxidation catalyst, the oxidization reaction of the particulates captured by the filter body can be accelerated by the oxidation catalyst to thereby attain further reliable burn-off of the particulates in a region of operation with lower exhaust temperature.

EXPLANATION OF THE REFERENCE NUMERALS

Figure 1:
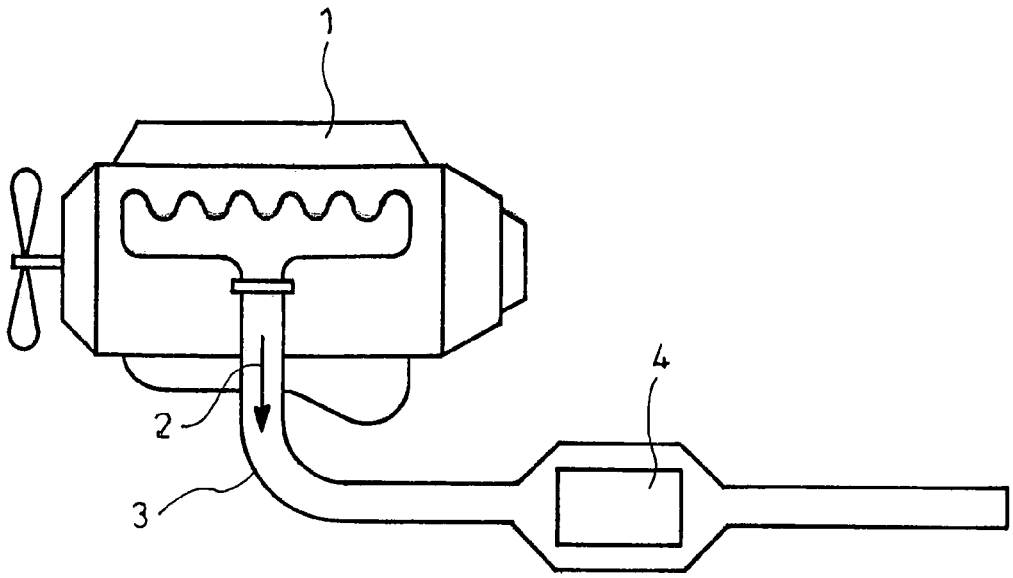
[FIG. 1] A schematic view showing arrangement of a conventional particulate filter.

2 exhaust gas
3 exhaust pipe
7 filter body
9 electric heater
9' electric heater
10 heat regenerative particulate filter
11 filter casing
12 filter casing
13 upstream oxidation catalyst
14 downstream oxidation catalyst
15 exhaust shutter
16 exhaust shutter
22 air pump
25 air induction pipe
26 air induction pipe

BEST MODE FOR CARRYING OUT THE INVENTION

An embodiment of the invention will be described in conjunction with the drawings.

Figure 2:
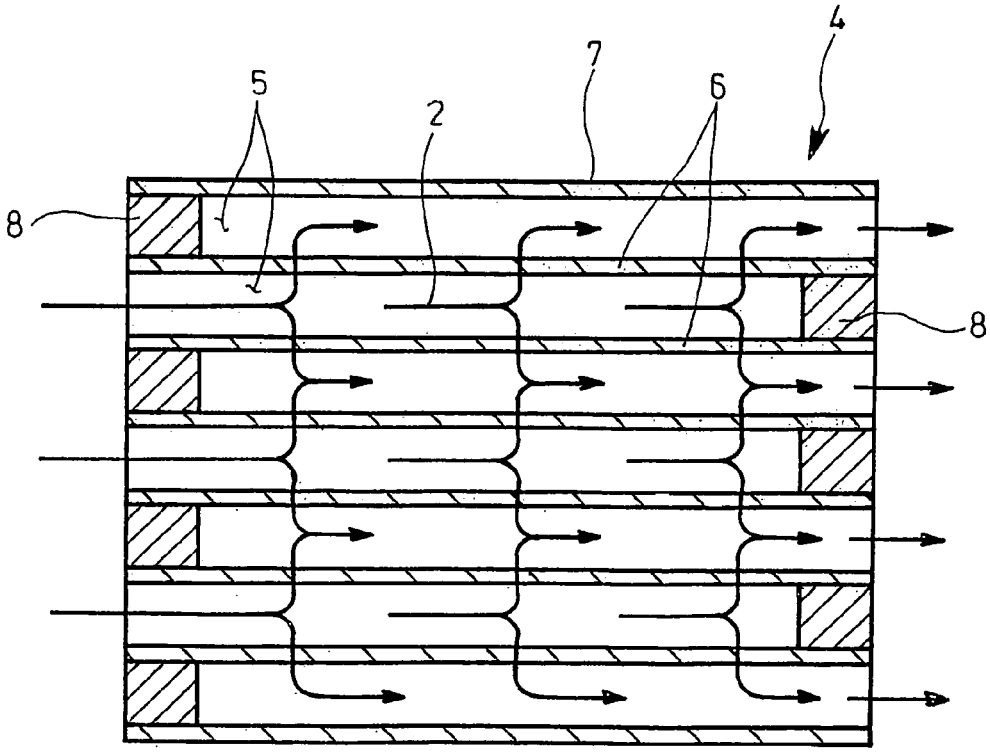
[FIG. 2] A sectional view showing particulars of the particulate filter in FIG. 1.
Figure 3:
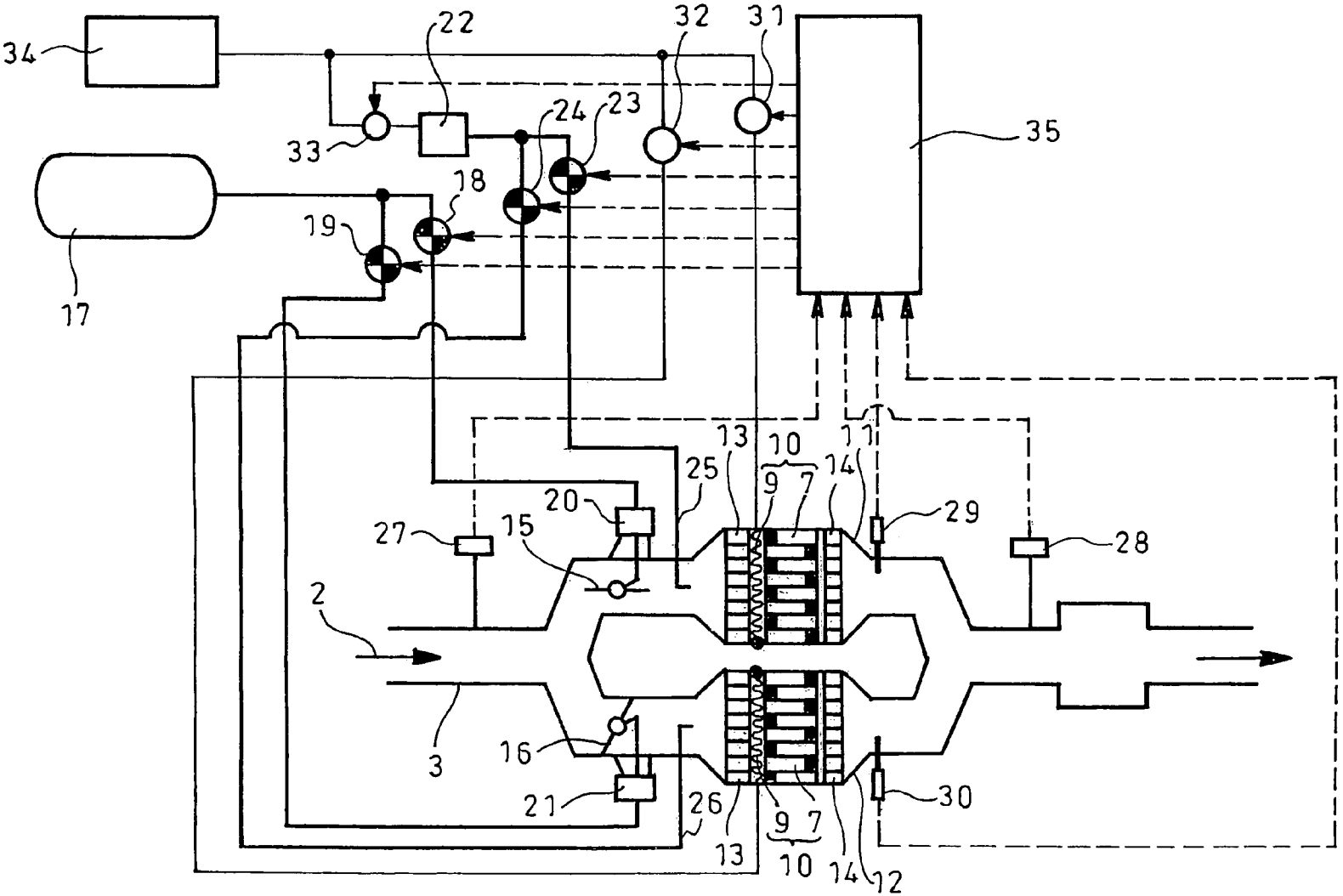
[FIG. 3] A general and schematic view showing an embodiment of the invention.
Figure 4:
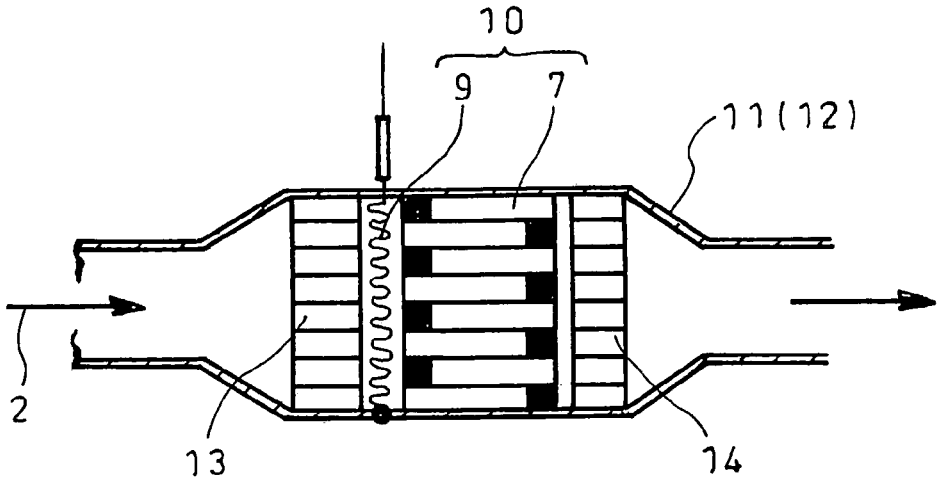
[FIG. 4] An enlarged sectional view showing a major portion of FIG. 3.

FIGS. 3 and 4 show an embodiment of the invention in which parts similar to those shown in FIGS. 1 and 2 are represented by the same reference numerals.

As shown in FIGS. 3 and 4, a heat regenerative particulate filter 10 used in an exhaust emission control device according to the invention is constituted by a filter body 7 made from silicon carbide and having a structure same as that shown in FIG. 2 and an electric heater 9 such as sheathed heater fitted to a front end surface of the filter body. Shown here is an example in which an exhaust pipe 3 is separated halfway into two passages into which filter casings 11 and 12 are incorporated in parallel with each other and in pairs, the heat regenerative particulate filter 10 being accommodated in each of the filter casings 11 and 12.

Oxidation catalysts 13 and 14 are arranged respectively upstream and downstream of and adjacent to the particulate filter 10 in each of the filter casings 11 and 12 so as to obtain thermo-keeping or heat insulation effect to the particulate filter 10.

These upstream and downstream oxidation catalysts 13 and 14 are of flow-through type ones comprising a carrier in the form of honeycomb made of ceramics such as cordierite and an appropriate amount of platinum carried by the carrier; a volume and a carried platinum amount of the downstream oxidation catalyst 14 may be decreased than those of the upstream oxidation catalyst 13.

Each of the filter bodies 7 in the filter casings 11 and 12 may integrally carry oxidation catalyst for the purpose of accelerating the oxidation reaction of the particulates captured by the filter body 7.

Furthermore, exhaust shutters 15 and 16 are respectively arranged on inlet sides of the respective filter casings 11 and 12 so as to selectively direct the exhaust gas 2 flowing through the exhaust pipe 3 into either of the filter casings 11 and 12, the exhaust shutters 15 and 16 being adapted to be selectively opened and closed by air cylinders 20 and 21 which in turn are driven by pressurized air from the an air tank 17 via electromagnetic valves 18 and 19, respectively.

Inserted and arranged just downstream of the exhaust shutters 15 and 16 are air induction pipes 25 and 26 which guide, via electromagnetic valves 23 and 24, combustion air taken in from an atmosphere by driving an air pump 22 to inlets of the filter casings 11 and 12.

In the figure, reference numerals 27 and 28 denote pressure sensors; 29 and 30, temperature sensors; 31 and 32, relays for the heaters; 33, relay for the pump: 34, battery; 35, an electronic control unit (ECU; engine control computer).

Thus, for example as shown in FIG. 3, when the driving or operation is carried out with the exhaust shutters 16 and 15 being respectively closed and opened for flow of the exhaust gas 2 only into the one filter casing 11, NO occupying majority of $NO_x$ in the exhaust gas 2 is converted into highly reactive $NO_2$ upon passing of the exhaust gas 2 in the filter casing 11 through the upstream oxidation catalyst 13, whereby the oxidation reaction of the particulate is substantially accelerated into sufficient burning-off under the operational condition of the exhaust temperature above about 250° C.

However, when a condition of light-load operation with temperature greatly falling below 250° C. continues for a long time, for example, during running or driving on congested city roads, satisfactory burn-off of the particulates cannot be expected. Then, when an accumulated particulate amount in the filter body 7 in the filter casing 11 is estimated on the basis of the detected values of the pressure sensors 27 and 28 to exceed a predetermined amount (estimation is based on pressure difference between the entering and discharge sides of the filter body 7), by the controller 35 the electromagnetic valve 18 is opened to close the exhaust shutter 15 and the electromagnetic valve 19 is closed to open the exhaust shutter 16, whereby the exhaust gas 2 is bypassed to the other filter casing 12 into the situation where the filter body 7 of the filter casing 11 is not exposed to the flow of the exhaust gas 2; then, the contact point of the relay 31 for the heater is closed to energize the electric heater 9 in the filter casing 11, so that the electric heater 9 is heated to positively heat the filter body 7 in the filter casing 11.

When positive heating of the filter body 7 by the electric heater 9 causes the exhaust temperature detected by the temperature sensor 29 to reach a predetermined value, then by the controller 35 the relay 33 for the pump is closed to drive the air pump 22 and the electromagnetic valve 23 is opened to introduce the combustion air from the air pump 22 into the inlet of the filter casing 11 via the air induction pipe 25.

When the exhaust gas 2 is bypassed in this manner and the heating by the electric heater 9 is continued with the combustion air guided to the inlet of the filter casing 11, heat by the electric heater 9 is effectively imparted to the filter body 7 without being robbed of by the exhaust gas 2, whereby the filter body 7 is effectively heated and the oxidization reaction of the particulates captured by the filter body 7 is promoted; moreover, oxidizing atmosphere around the filter body 7 is improved for easy burn-off of the captured particulate.

In this case, the heat regenerative particulate filter 10 is sandwiched and heat insulated by the upstream and downstream oxidation catalysts 13 and 14 in one and the same filter casing 11, 12, so that the beginning of the oxidization reaction of the captured particulates causes the filter body 7 to be rapidly elevated in temperature, whereby the particulates have tendency of being more easily burned off; as a result, the particulates can be completely burned off with a time period of energization shorter than that they could conventionally, resulting in reduction of the electric power consumption in comparison with the prior art.

The harmful gas such as highly concentrated CO or HC generated due to burn-off of the particulates by the heating of the electric heater 9 is oxidized into harmless $CO_2$ or $H_2O$ during passage of the downstream oxidation catalyst 14 and is discharged.

In a course of operations for a long period after completion of the regeneration in the filter body 7 in the one filter casing 11, the accumulated particulate amount in the filter body 7 in the other filter casing 12 may be estimated to excess the predetermined amount; then, the regeneration of the filter body 7 with respect to the other filter casing 12 may be conducted in the same manner as the above.

More specifically, by the controller 35 the electromagnetic valve 18 is closed to open the exhaust shutter 15 and the electromagnetic valve 19 is opened to close the exhaust shutter 16, whereby in this time, the exhaust gas 2 is bypassed to the one filter casing 11. The relay 32 for the heater is closed to energize the electric heater 9 in the filter casing 12, so that the electric heater 9 is heated to positively heat the filter body 7 in the filter casing 12; thereafter, when the exhaust temperature detected by the temperature sensor 30 reaches a predetermined value, by the controller 35 the contact point of the relay 33 for the pump is closed to drive the air pump 22 and the electromagnetic valve 24 is opened to introduce the combustion air from the air pump 22 into the inlet of the filter casing 12 via the air induction pipe 26.

Thus, according to the above embodiment, even in a condition of operation with lower exhaust temperature such as light-load operation, the particulates captured by the filter body 7 can be efficiently burned off by the heating of the electric heater 9; moreover, the filter body 7 can be rapidly elevated in temperature due to thermo-keeping or heat insulation effect by the upstream and downstream oxidation catalysts 13 and 14 into environment for ready burn-off of the particulates, so that the particulates can be burned off with a shorter energization time than they could conventionally, whereby electric power consumption can be substantially reduced.

The harmful gas such as highly concentrated CO or HC generated due to combustion of the particulates with relatively low temperature by the heating of the electric heater 9 is oxidized into harmless $CO_2$ or $H_2O$ when it passes through the downstream oxidation catalyst 14 and is discharged. As a result, the harmful gas is prevented from remaining in the exhaust gas 2 finally discharged into the atmosphere.

NO occupying majority of $NO_x$ in the exhaust gas 2 can be converted into highly reactive $NO_2$ when the exhaust gas passes through the upstream oxidation catalyst 13, which substantially accelerates the oxidization reaction of the particulates under a condition of operation with relatively high exhaust temperature, whereby spontaneous combustion of the particulates is promoted with no heating by the electric heater 9, thereby providing satisfactory burn-off of the particulates.

Especially in the present embodiment, the filter casings 11 and 12 are arranged in pairs and in parallel with each other for alternate flow of the exhaust gas 2, so that the exhaust gas 2 is made to bypass either of the filter casings 11 and 12, which makes it possible to effectively heat the other filter body 7 by the electric heater 9 without being exposed to the flow of the exhaust gas 2.

Moreover, while the filter body 7 of the one filter casings 11 is regenerated, the filter body 7 of the other filter casing 12 can continue to capture the particulates, so that any of the filter bodies 7 in the filter casings 11 and 12 can be in a usable situation to thereby attain continuous reduction of the particulates.

Moreover, since the combustion air can be introduced from the air pump 22 via the air induction pipe 25 or 26 to the filter casing 11 or 12 which is bypassed by the exhaust gas 22, the oxidizing atmosphere around the filter body 7 can be improved into further easiness in burning-off of the captured particulates, so that the burning off of the particulates can be completed with still shorter time period of energization, thereby attaining further substantial reduction in electric power consumption.

In a case where the filter body 7 integrally carries oxidation catalysts, the oxidation reaction of the particulates captured by the filter body 7 can be accelerated by the oxidation catalysts, so that further reliable burn-off of the particulates can be attained in a region of operation with lower exhaust temperature.

Figure 5:
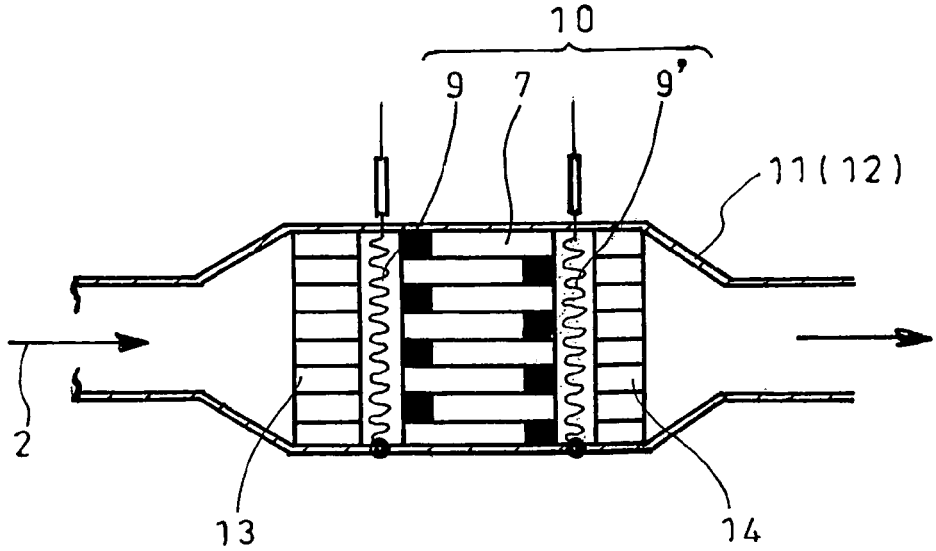
[FIG. 5] A sectional view showing another embodiment of the invention.

FIG. 5 shows a further embodiment of the invention. Though the embodiment of FIGS. 3 and 4 exemplifies a case where the front end surface of the filter body 7 is provided with the electric heater 9, as shown in the embodiment of FIG. 5 an electric heater 9' may be also provided on a rear end surface of the filter body 7 as needs demand so as to enhance heating force to the filter body 7. In this case, though electric power consumption per unit time is increased in comparison with that of the above-mentioned embodiment, a time period necessary for completion of the burn-off of the particulate may be shorter; as a result, the total electric power consumption may be suppressed than ever before.

It is to be understood that an exhaust emission control device according to the invention is not limited to the above-mentioned embodiments and that various changes and modifications may be made without leaving the gist of the invention. For example, the filter casings may be arranged not in pairs and in parallel with each other; a bypass passage may be arranged to bypass, for example, a single filter casing; the filter body may not carry the oxidation catalyst: and the filter body may be of a shape different from that shown in the figures.

The invention claimed is:

1. An exhaust emission control device comprising:

a porous filter body through which exhaust gas passes and which is configured to capture particulates entrained in the gas;

a first electric heater that heats the filter body to thereby provide a heat regenerative particulate filter, said heat regenerative particulate filter being accommodated in a filter casing within an exhaust pipe, a second electric heater disposed downstream of the particulate filter; and upstream and downstream oxidation catalysts arranged upstream and downstream, respectively, of and adjacent to the particulate filter in the filter casing so as to provide a thermo-keeping effect to the particulate filter, wherein the exhaust gas arbitrarily bypasses the filter casing, the filter body has a plurality of passages in the form of a honeycomb through which the exhaust gas passes, inlets and outlets of the respective passages being alternately plugged, said first heater is upstream of the particulate filter and downstream of the upstream oxidation catalyst, and the second heater is upstream of the downstream oxidation catalyst.

* * * * *